US005428974A

United States Patent [19]

Shinohara

[11] Patent Number: 5,428,974

[45] Date of Patent: Jul. 4, 1995

[54] ORNAMENT

[76] Inventor: Nobuhiro Shinohara, 1-34-21-302, Ebisu-Nishi, Shibuya-Ku, Tokyo, Japan

[21] Appl. No.: 112,464

[22] Filed: Aug. 27, 1993

[30] Foreign Application Priority Data

Apr. 9, 1993 [JP] Japan ..... 5-107734

[51] Int. Cl.[6] ..... A44C 9/00

[52] U.S. Cl. ..... 63/15; 63/15.1; 63/28

[58] Field of Search ..... 63/15, 15.1, 15.2, 15.3, 63/15.4, 15.45, 28; D11/26, 28, 29, 34

[56] References Cited

U.S. PATENT DOCUMENTS

| | | | |
|---|---|---|---|
| D. 66,636 | 2/1925 | Knapp | D11/26 |
| 211,558 | 1/1879 | Edwards | 63/15 |
| D. 215,613 | 10/1969 | Wilkinson | D11/34 |
| D. 225,018 | 10/1972 | Shiman | D11/34 |
| D. 226,447 | 3/1973 | Shiman | D11/34 |
| 252,998 | 1/1882 | Brunswick et al. | 63/15.3 |
| D. 291,664 | 9/1987 | Kelman | D11/28 |
| 367,896 | 8/1887 | Davidson | 63/15.3 |
| 858,450 | 7/1907 | Greenbaum | 63/15.2 |
| 1,536,540 | 5/1925 | Thomas | 63/15.3 |
| 1,972,128 | 9/1934 | Bobbroff | 63/15.3 |
| 2,493,285 | 1/1950 | Granat | 63/15.2 |
| 5,129,851 | 7/1992 | Villanueva | 63/15 |

*Primary Examiner*—Michael J. Milano
*Attorney, Agent, or Firm*—Marks & Murase L.L.P.; Michael D. Bednarek

[57] ABSTRACT

An ornament has a jewelry holding member which is provided jewelry mounts both on the upper and lower sides thereof, and a plurality of rings which are rotatably secured to the jewelry holding member in such a manner as to cross one another. According to the present invention, since a plurality of rings are rotatable secured to a jewelry holding member at positional offset from one another, a single jewelry ring can have two designs which are entirely different from each other, and either one of these designs can be selectively displayed without requiring any change in the construction of the ring.

20 Claims, 11 Drawing Sheets

ORNAMENT

BACKGROUND OF THE INVENTION

1. Field of the Invention

The present invention relates to an ornament such as a ring which has a pair of jewelry mounts and a plurality of rotatable rings so that the jewelry mounted on either the jewelry mount can be displayed by rotating the rings.

2. Description of the Related Art

A ring, a bracelet, an anklet, a watch and so on are known as ornaments having jewelry or pearls. Among various such ornaments, a ring will be specifically mentioned in the following description. A conventional ring has a jewelry holding member having a jewelry mount for holding one or more jewels, and a ring member which is formed integrally with the jewelry holding member and into which a finger of the wearer is inserted. Alternatively, a ring member is fixed to a jewelry holding member provided with a jewelry mount. Consequently, one ring can only have one design.

In recent years, design of a jewelry ring or a pearl ring has been diversified in order to meet demands for a variety of fashion coordination. Namely, the ring is usually selected in accordance with the air or atmosphere and in coordination with the clothes or suits. However, since one ring can have only one design, it is necessary to have a plurality of rings, in order to enjoy different designs of rings in accordance with the air, atmosphere and clothes design.

Carrying a plurality of rings, however, poses a risk that the rings may be lost or damaged.

SUMMARY OF THE INVENTION

The present invention has been accomplished in view of the problem described above. An object of the present invention is to provide an ornament such as a ring or a bracelet that can have two different designs and either one of such two designs can easily be displayed and presented.

According to one aspect of the present invention, for achieving the objects described above, there is provided an ornament comprising a jewelry holding member which is provided with jewelry mounts both on the upper and lower sides thereof, and a plurality of rings rotatably secured to the jewelry holding member in such a manner as to cross one another.

According to another aspect of the present invention, there is provided an ornament comprising a jewelry holding member which is provided with jewelry mounts both on the upper and lower sides thereof, and two rings rotatably secured to the jewelry holding member.

nature, principle and utility of the invention will become more apparent from the following detailed description when read in conjunction with the accompanying drawings.

BRIEF DESCRIPTION OF THE DRAWINGS

In the accompanying drawings:

FIGS. 1A to 1C are perspective views of an embodiment of a ring as an example of the ornament in accordance with the present invention, wherein FIG. 1A shows a state in which one of the jewels is displayed, FIG. 1B shows an intermediate state in which the display of the ring is being change-over and FIG. 1C shows a state in which the other jewel is displayed;

FIGS. 2A to 2D are illustrations of the ring as an ornament of the invention shown in FIGS. 1A to 1C, wherein FIG. 2A is a plan view of the ring when one of the jewelry is displayed, FIG. 2B is a side elevational view, FIG. 2C is a front elevational view and FIG. 2D is a plan view of the state in which the other jewelry is displayed;

FIGS. 10A to 10C are perspective views of an embodiment of a ring as an example of the ornament in accordance with the present invention, wherein FIG. 10A shows a state in which one of the jewel is displayed, FIG. 10B shows an intermediate slate in which the display of the ring is being changed-over and FIG. 10C shows a slate in which the other jewel is displayed;

FIGS. 11A to 11D are illustrations of the ring as an ornament of the invention shown in FIGS. 10A to 10C, wherein FIG. 11A is a plan view of the ring when one of the jewelry is displayed, FIG. 11B is a side elevational view, FIG. 11C is a front elevational view and FIG. 11D is a plan view of the slate in which the other jewelry is displayed;

FIGS. 18A to 18C are perspective views of still another embodiment of a ring in accordance with the present invention, wherein FIG. 18A shows a state in which the jewelries are displayed, FIG. 18B shows an intermediate state in which the display of the ring is being changed-over and FIG. 18C shows a state in which the other jewelries are displayed.

DESCRIPTION OF THE PREFERRED EMBODIMENTS

The ornament of the present invention can be carried out in various forms such as a ring, a bracelet, an anklet, a watch and so on, although a ring is specifically described in detail as an embodiment of the present invention.

Figure 1A:
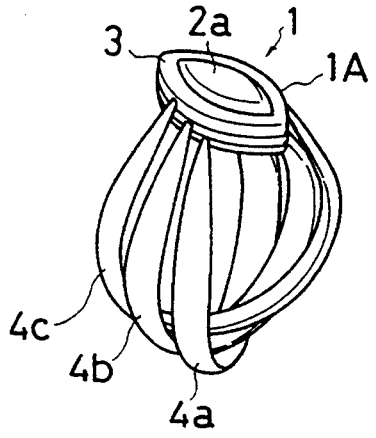
Figure 1B:
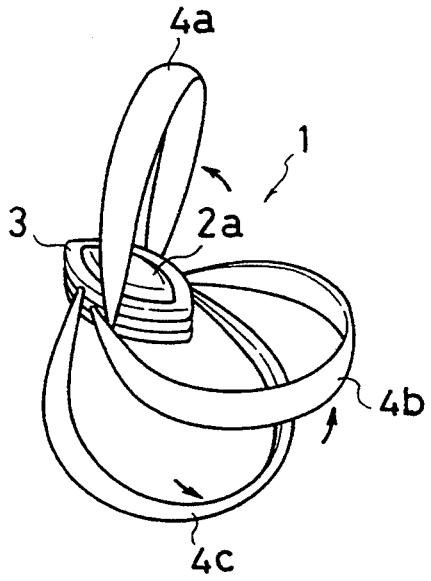
Figure 1C:
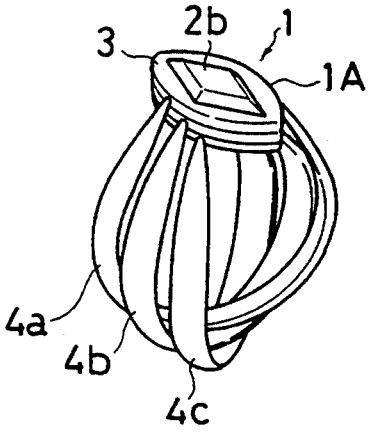

FIGS. 1A to 1C are perspective views of an embodiment of the ring 1 in accordance with the present invention, while FIGS. 2A to 2D show plan and side elevations of the ring 1.

A jewelry holding member 1A is made of, for example, a precious metal or the like and has a substantially cylindrical form without a bottom. The outer peripheral surface of the jewelry holding member 1A has plural steps (in this case, two steps). A jewel 2*a* is inserted from one of the two openings of the cylindrical jewelry holding member 1A and is seated by one of the steps. The portion of the jewelry holding member 1A providing the opening brim is caulked to fix and hold the jewelry 2*a*. Similarly, another jewel 2*b* is inserted into the jewelry holding member 1A through the other opening so as to be seated on the other step, and is fixed and held as the portion of the jewelry holding member 1A providing the opening brim is caulked onto the jewel 2*b*. Thus, the opening brims of the jewelry holding member 1A serve as jewelry mount portions 3.

Figure 2A:
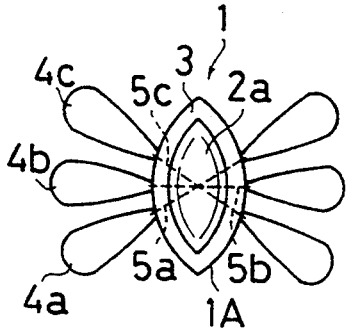
Figure 2B:
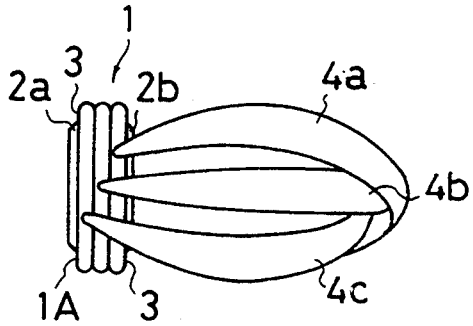
Figure 2C:
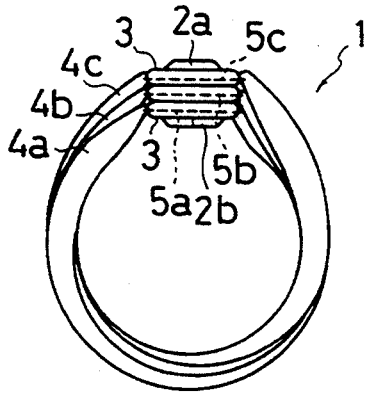
Figure 2D:
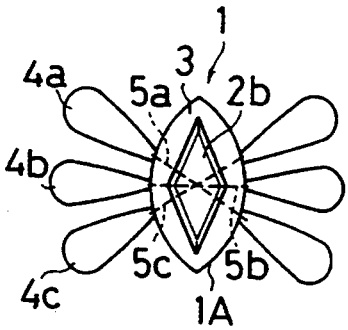

The outer peripheral surface of the jewelry holding member 1A is sectioned into three stages by the above-mentioned two steps. Three substantially cylindrical rings 4*a* to 4*c* made of precious metals or the like are secured to the outer peripheral surface of the jewelry holding member 1A rotatably in such a manner that they cross one another at portions remote from the jewelry holding member 1A. More specifically, as shown by broken lines in FIGS. 2A, 2B and 2D, pins 5*a* to 5*c* are rotatably inserted into the jewelry holding member 1A at each of the three stages of the outer peripheral surface. Thus, there are three pins 5*a* to 5*c* in total and these pins 5*a* to 5*c* are arranged to cross one another. Notched ends of each rings 4*a* to 4*c* are respectively secured to corresponding ends of the pins 5*a* to 5*c* projecting out of the jewelry holding member 1A. The three rings 4*a* to 4*c* have an identical configuration and are secured to different stages of the outer peripheral surface of the jewelry mounting member 1A, i.e., with positional offset from one another, so that they cross one another at ends remote from the jewelry holding member 1A as illustrated in FIGS. 2B and 2C. In order to enable smooth rotation of the respective rings 4*a* to 4*c*, the three pins 5*a* to 5*c* extend in parallel with one another.

A description will now be given of the manner in which the ornament ring 1, as shown in FIGS. 1A to 1C and FIGS. 2A to 2D, having the described construction is used.

The ring 1 according to the present invention can simultaneously have two types of designs which are entirely different from each other, and can easily display only the selected one of these designs. That is, the ring 1 can have a design for displaying the jewel 2*a* and further another design for displaying the jewelry 2*b*. Change-over between the displays of these designs can easily be conducted by the following method.

It is assumed here that a design employing the jewel 2*a* has been initially displayed, as shown in FIG. 1A. In order to change-over the design to the one which exhibits the jewel 2*b*, the rings 4*a* to 4*c* are sequentially rotated 180°, starting with the outermost ring 4*a* as shown in FIG. 1B, and ending with-the innermost ring 4*c* as shown in FIG. 1C. The direction of rotation is exemplarily shown by arrows but this direction is only illustrative and the rotation in the counter direction provides the same effect. Consequently, the design employing the jewel 2*a*, which has been displayed, is turned so as to be directed inwardly of the rings 4*a* to 4*c*, whereas the design employing the jewelry 2*b*, which has not been displayed, is turned to be directed outward, whereby the appearance is switched to exhibit the design employing the jewel 2*b* visible.

Figure 3:
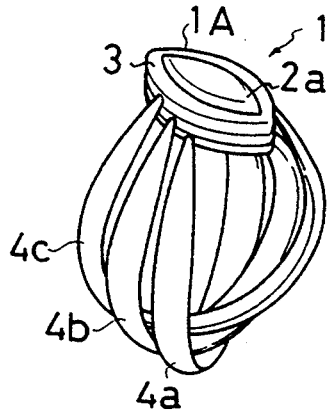
FIG. 3 is a first drawing illustrative of the change-over of the state of display of the ring shown in FIGS. 1A to 1C as an example of the ornament of the present invention.
Figure 4:
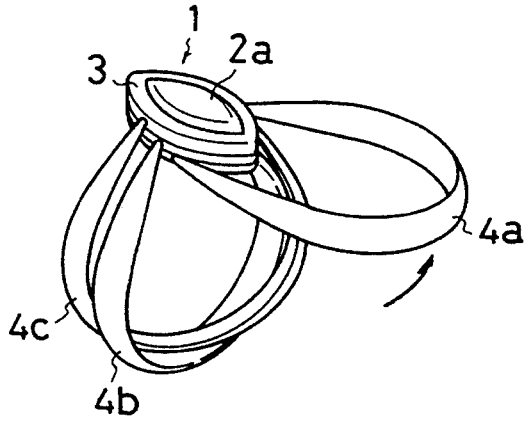
FIG. 4 is a second drawing illustrative of the change-over of the state of display of the ring shown in FIGS. 1A to 1C as an example of the ornament of the present invention.
Figure 5:
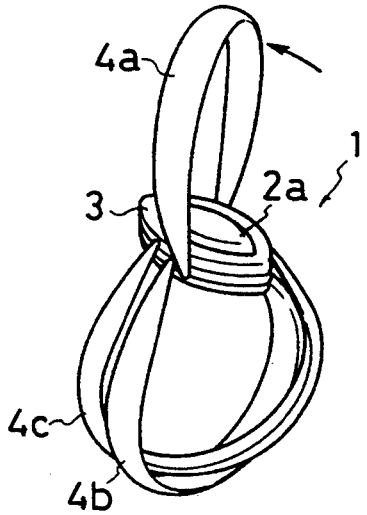
FIG. 5 is a third drawing illustrative of the change-over of the state of display of the ring shown in FIGS. 1A to 1C as an example of the ornament of the present invention.
Figure 6:
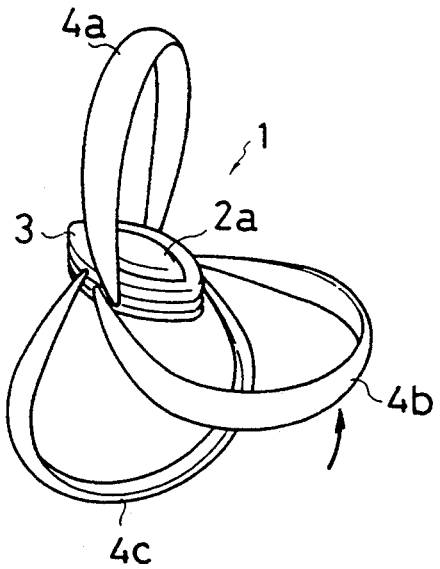
FIG. 6 is a fourth drawing illustrative of-the change-over of the state of display of the ring shown in FIGS. 1A to 1C as an example of the ornament of the present invention.
Figure 7:
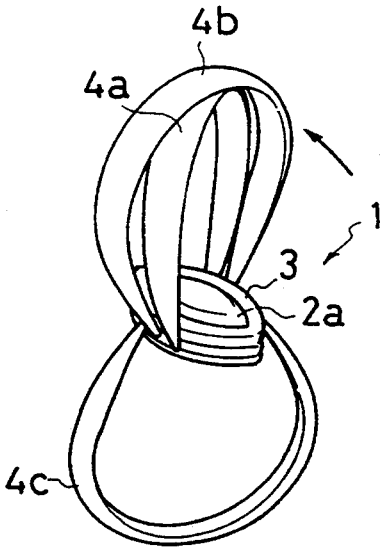
FIG. 7 is a fifth drawing illustrative of the change-over of the state of display of the ring shown in FIGS. 1A to 1C as an example of the ornament of the present invention.
Figure 8:
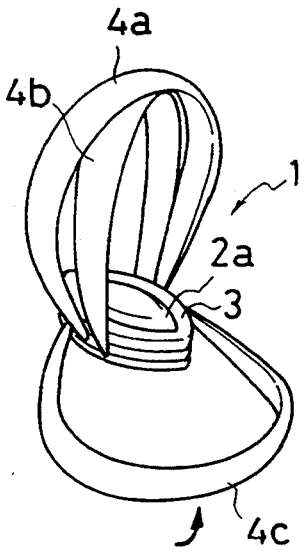
FIG. 8 is a sixth drawing illustrative of the change-over of the state of display of the ring shown in FIGS. 1A to 1C as an example of the ornament of the present invention.
Figure 9:
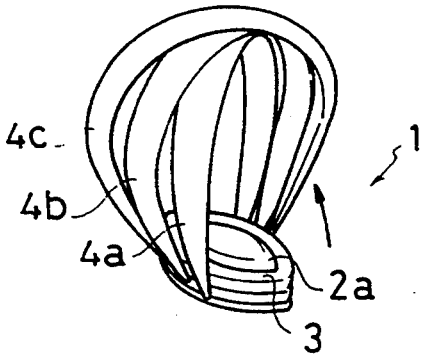
FIG. 9 is a seventh drawing illustrative of the change-over of the slate of display of the ring shown in FIGS. 1A to 1C as an example of the ornament of the present invention.

This operation will be described in more detail with reference to FIGS. 3 to 9. The ring 1 is first set to a state in which the design employing the jewel 2*a* is exhibited (FIG. 3). Then, the outermost ring 4*a* extracted and rotated (FIG. 4) through 180° from the initial position, so as to be set at a position above the jewel 2*a* (FIG. 5). Similarly, the next ring 4*b*, which is the second from the outermost one 4*a*, is extracted and rotated (FIG. 6) through 180° from the initial position, so as to be set at a position above the jewel 2*a* (FIG. 7). Finally, the innermost ring 4*c* is extracted and rotated (FIG. 8) through 180° from the initial position, so as to be set at a position above the jewel 2*a* (FIG. 9). As a result of this series of the change-overing operation, the design employing the jewelry 2*a* which has been displayed is turned to be directed inward of the rings 4*a* to 4*c*, whereas the design employing the jewel 2*b* which has been hidden is turned to be directed outward of the rings 4*a* to 4*c*.

Since the rings 4*a* to 4*c* are respectively mounted with positional offsets on the side of the jewelry holding member 1A, the ring 4*a* which has been disposed at the outermost position occupies the innermost position, whereas the ring 4*c* which has been placed at the innermost position is comes to occupy the outermost position, whereby the three rings 4*a* to 4*c* cross one another at the portions thereof remote from the jewelry holding member 1A.

FIGS. 10A to 10G are perspective views of another embodiment of the ring 11 in accordance with the present invention, while FIGS. 11A to 11D show plans and side elevations of the same.

This embodiment incorporates a jewelry holding member 11A having a cylindrical outer surface which has a step to present two stages, and fixing and holding of the jewels 2*a* and 2*b* are done in the same way as the preceding embodiment. A pair of rings 4*a* and 4b are rotatably secured to the outer peripheral surface of the jewelry holding member 11A such that these rings 4*a* and 4*b* cross each other at their portions remote from the jewelry holding member 11A. More specifically, a pair of pins 5*a* and 5*b* are rotatably inserted into the jewelry holding member 11A as shown by broken lines in FIGS. 11A, 11B and 11D, and the rings 4*a* and 4*b* are respectively fixed at its both notched ends to both ends of the corresponding pins 5a and 5b projecting out of the jewelry holding member 11A. These two rings 4a and 4b have an identical configuration and are secured to different stages of the surface of the jewelry holding member 11A, i.e., with positional offsets from each other, so that the rings 4a and 4b cross each other at their portions remote from the jewelry holding member 11A. Preferably, two pins 5a and 5b extend in parallel with each other so as to ensure smooth rotation of the rings 4a and 4b.

A description will now be given of the manner in which the ring 11 having the described construction is used with reference to FIGS. 11A to 11D.

Figure 10A:
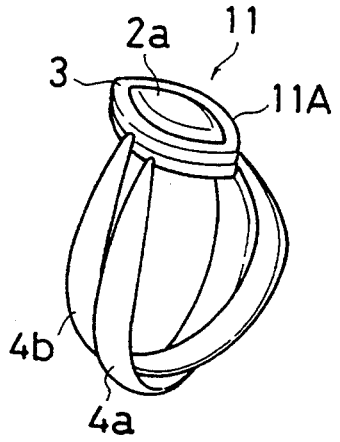
Figure 10B:
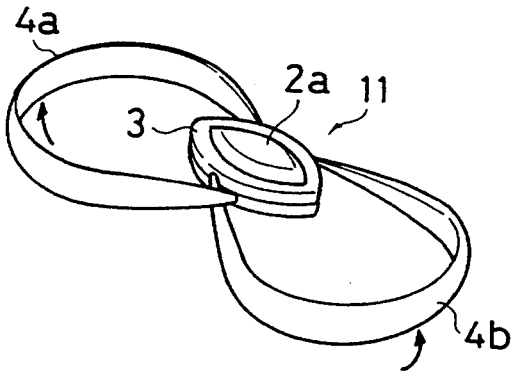
Figure 10C:
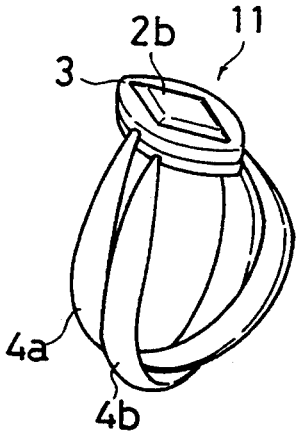

It is assumed here that the design employing the jewel 2a is initially displayed, as shown in FIG. 10A. In order to change-over the display such that the design employing the jewel 2b is displayed, two rings 4a and 4b are rotated in counter directions as indicated by arrows in the figure or in the same direction through 180°, so that the design employing the jewel 2a, which has been displayed, is directed inward of the rings 4a and 4b, whereas the design employing the jewel 2b which has been hidden is directed outward of the rings 4a and 4b, whereby the design employing the jewelry 2b becomes visible as shown in FIG. 10C. Since the rings 4a and 4b are mounted with positional offset on the side of the jewelry holding member 11A, the ring 4a which has been placed at the outer position becomes to occupy the inner position, whereas the ring 4b which has been placed at the inner position becomes to occupy the outer position, with the result that both rings 4a and 4b cross each other at their portions remote from the jewelry holding member 11A.

Figure 12:
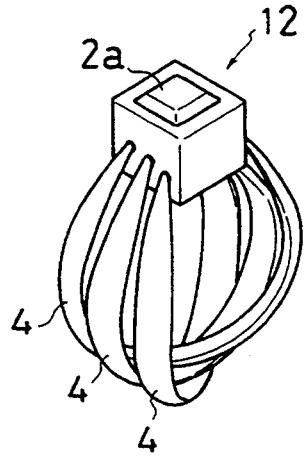
FIG. 12 is a perspective view of a second embodiment of a jewelry holding member of a ring as an example of the ornament in accordance with the present invention.
Figure 13:
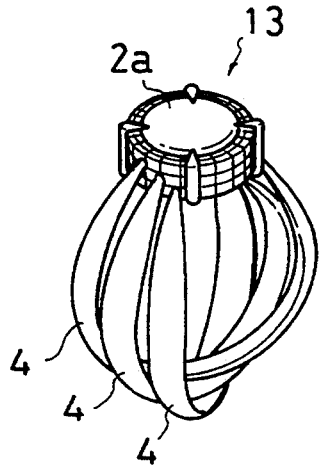
FIG. 13 is a perspective view of a third embodiment of a jewelry holding member of a ring as an example of the ornament in accordance with the present invention.
Figure 14:
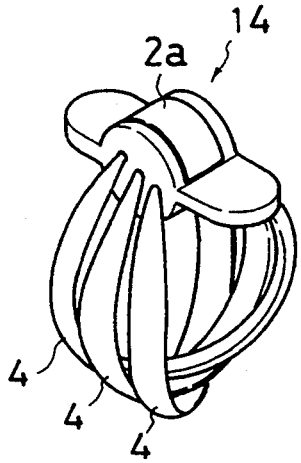
FIG. 14 is a perspective view of a fourth embodiment of a jewelry holding member of a ring as an example of the ornament in accordance with the present invention.

In each of the embodiments described hereinbefore, the jewelry holding member has a stepped cylindrical form without any bottom. This, however, is only illustrative and the jewelry holding member can have any other suitable form, whether stepped or not and whether there is a bottom or not. Thus, the jewelry holding member may be in the form of a pyramid made of a precious metal or the like, as shown in FIG. 12, a cage-like form assembled from wires of a precious metal or the like, as shown in FIG. 13, a tabular form made of a precious metal or the like, as shown in FIG. 14, and so forth. The jewelry mount portion also can have any suitable configuration. The configuration of the jewelry mount portion, however, is preferably determined taking into account the geometry of the jewelry holding member. For instance, when the jewelry holding member has a substantially cylindrical form with or without a bottom, pyramidal form or cage-like form, it is preferred that the jewelry mount portion is so configured as to be able to hold the jewel or pearl by caulking, whereas, when the jewelry holding member has a tabular form, the jewelry mount portion is so configured as to hold and fix the jewel or pearl by embedding.

Figure 15:
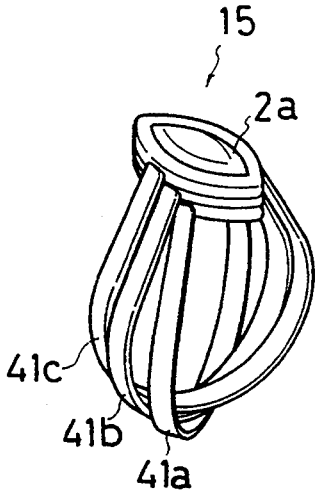
FIG. 15 is a perspective view of a second embodiment of a ring member of a ring as an example of the ornament in accordance with the present invention.
Figure 16:
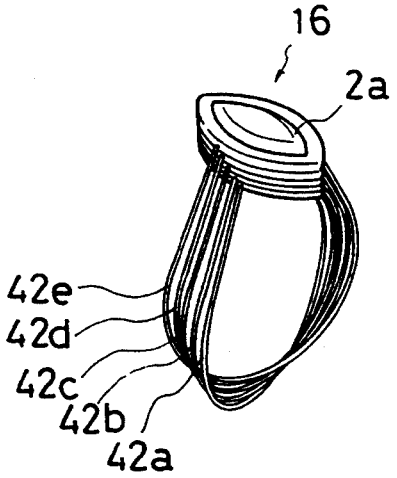
FIG. 16 is a perspective view of a third embodiment of a ring member of a ring as an example of the ornament in accordance with the present invention.
Figure 17A:
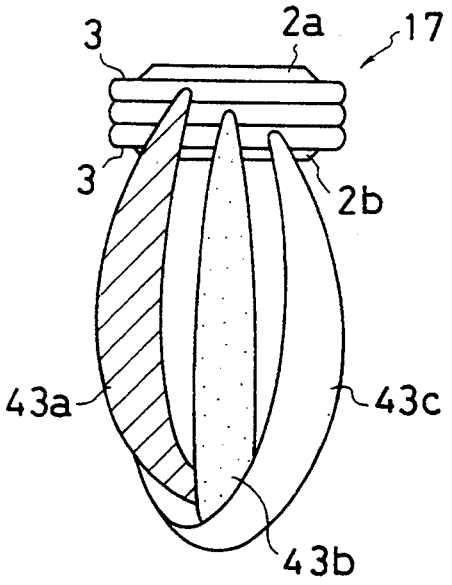
FIGS. 17A and 17B are perspective views of a fourth embodiment of a ring member of a ring as an example of the ornament in accordance with the present invention.
Figure 17B:
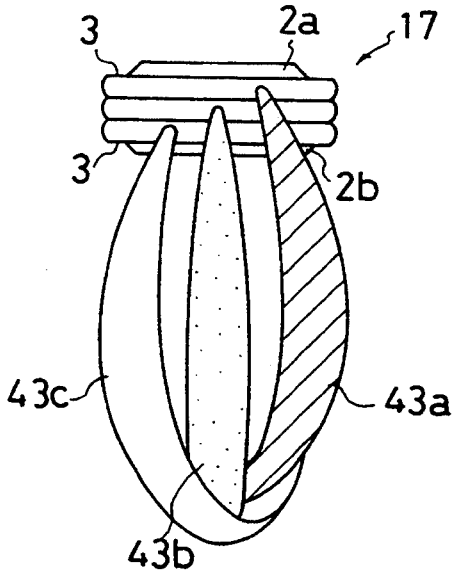

Although the rings 4a to 4c in each of the preceding embodiments have substantially circular cross-sections, the ring member can have a polygonal cross-section as shown in FIG. 15 (rectangular cross-section in this case) or other suitable cross-sectional shape. It is also possible to form the ring members from a line or wire as shown in FIG. 16. The number of the ring members is not limited to two or three. For instance, it is possible to employ five ring members, as shown in FIG. 16. Any desired number of rings out of the plurality of ring members, e.g., all the three rings 43a, 43b, 43c may be formed of precious metals of different colors as shown in FIG. 17, or may have different designs. It is also possible to design such that a desired number of ring members out of the plurality of ring members have different diameters. Such difference in color, disign or diameter improves the appearance of the ornament ring. FIGS. 17A and 17B are side elevational view of an ornament ring, as viewed in two different directions. Although in the described embodiments the ring members are rotatably secured to the jewelry holding member by means of pins, they may be directly secured rotatably to the jewelry holding member by caulking.

Figure 11A:
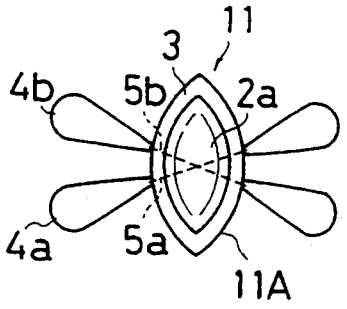
Figure 11B:
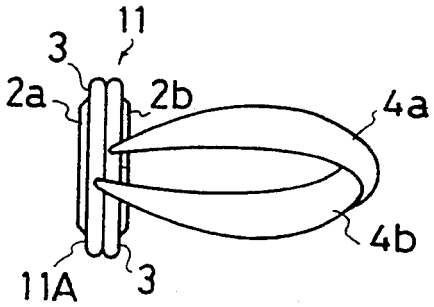
Figure 11C:
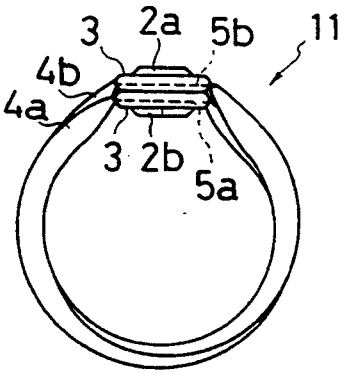
Figure 11D:
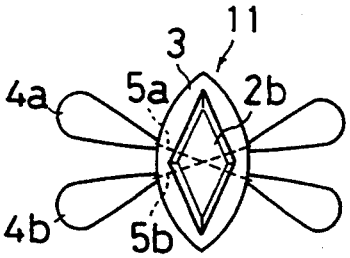

Preferably, the jewelry or pearl, as well as the jewel (gemstone) mount portion, which is hidden behind the ring members is prevented from being contaminated by fat or the like due to contact with the wearer's finger. More specifically, it is preferred that a certain gap is left between the jewel 2a or 2b fixed to the jewelry holding member 1A or 11A and the wearer's finger received in the rings 4, as shown in FIG. 2B or FIG. 11B. Although preferred embodiments have been described with specific reference to ornament rings, the described advantages of the present invention can equally be enjoyed also when the invention is carried out in the form of other types of ornaments having rings, such as a bracelet, an anklet or a watch.

As has been described, the ornament of the present invention can simultaneously have two entirely different designs either one of which can be selected easily for display while the other is hidden. One ornament ring, therefore, can be used in two modes, either one of which being selectable according to air and atmosphere, as well as in coordination with the clothes. The ornament of the invention will not be lost insofar as it is put on the user's finger, thus eliminating the risk of losing which may occur when two separate rings are used. Furthermore, the user can enjoy drastic change in the design of the ornament, while enabling the designer to adopt an extremely bold or unique design which hitherto could not be adopted due to taste of the purchasers. Thus, the present invention offers an extensive diversification of design of ornaments.

Figure 18A:
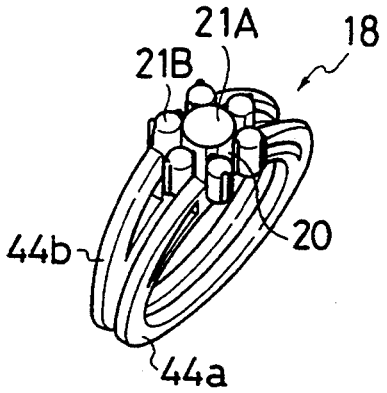
Figure 18B:
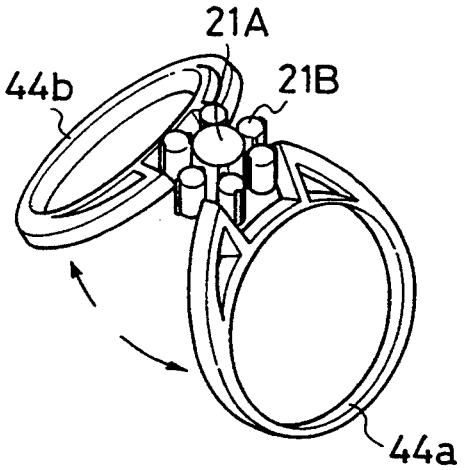
Figure 18C:
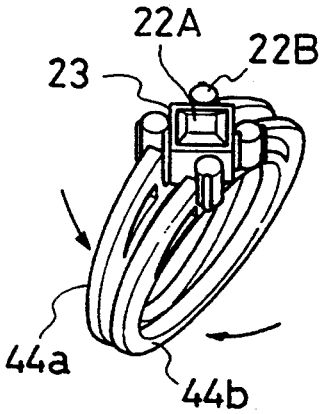

FIG. 18A is a perspective view of still another embodiment of a ring 18 of the present invention, while FIGS. 18B and 18C show a plan and a side elevation of the ring 18, respectively.

Although the ring members of the above embodiments are two or more and are rotatably secured to the jewelry holding member in such a manner as to cross one another, rings 44a and 44b of the ring 18 in this embodiment are two and do not cross one another. As described above, a jewelry holding member 20 is made of a precious metal or the like and has a substantially cylindrical form without a bottom. A central jewel 21A is inserted from one of the two openings of the cylindrical jewelry holding member 20 and peripheral jewels 21B are provided at side-top portions of the jewelry holding member 20. The portion of the jewels holding member 20 providing the opening brim is caulked to fix and hold the jewelry 21A. Similarly, another central jewelry 22A is inserted into the jewelry holding member 20 through the other opening, and is fixed and held as the portion of the jewelry holding member 20 providing the opening brim is caulked onto the jewel 22A. Thus, the opening brims of the jewelry holding member 20 serve as jewelry mount portions 23. Further, another peripheral jewelries 22B are provided at another side-top portions of the jewelry holding member 20.

description will now be given of the manner in which the ornament ring 18, as shown in FIGS. 18A to 18C, having the described construction is used. It is assumed here that a design employing the jewelries 21A and 21B have initially displayed as shown in FIG. 18A. In order-to change-over the design to the one which exhibits the jewelries 22A and 22B, the rings 44*a* and 44*b* are sequentially or at the same time rotated 180° by fingers as shown in FIG. 18B. Consequently, the design employing the jewelries 21A and 21B which have been displayed are turned so as to be directed inwardly of the rings 44*a* and 44*b*, whereas the design employing the jewelries 22A and 22B which have not been displayed are turned to be directed outward, whereby the appearance is switched to exhibit the design employing the jewelries 22A and 22B visible as shown in FIG. 18C.

It should be understood that many modifications and adaptations of the invention will become apparent to those skilled in the art and it is intended to encompass such obvious modifications and changes in the scope of the claims appended hereto.

What is claimed is:

1. An ornament, comprising: a jewelry holding member having jewelry mounts on upper and lower sides thereof; and a plurality of rings rotatably secured to the said jewelry holding member in such a manner that said rings cross one another.

2. An ornament according to claim 1, wherein said jewelry holding member has a substantially cylindrical form.

3. An ornament according to claim 1, wherein said jewelry holding member has a pyramidal form.

4. An ornament according to claim 1, wherein said jewelry holding member has a cage-like form.

5. An ornament according to claim 1, wherein said jewelry holding member has a tabular form.

6. An ornament according to claim 1, wherein two rings are provided.

7. An ornament according to claim 1, wherein three rings are provided.

8. An ornament according to claim 1, wherein at least four rings are provided.

9. An ornament according to claim 1, wherein said jewelry mounts have such a construction as to hold and fix a jewelry by being caulked.

10. An ornament according to claim 1, wherein said jewelry mounts have such a construction that a jewelry is held and fixed by being embedded.

11. An ornament according to claim 1, wherein each said ring has a substantially circular cross-section.

12. An ornament according to claim 1, wherein each said ring has a polygonal cross-section.

13. An ornament according to claim 1, wherein each said ring has a linear form.

14. An ornament according to claim 1, where at least two of said rings are made of precious metals of different colors.

15. An ornament according to claim 1, where at least two of said rings are made of precious metals of different designs.

16. An ornament according to claim 1, where at least two of said rings have different diameters.

17. An ornament according to claim 1, wherein said rings are secured to said jewelry holding member by being fixed to a plurality of pins which are rotatably inserted into said jewelry holding member.

18. An ornament according to claim 1, wherein said rings are secured to said jewelry holding member by being rotatably caulked thereto.

19. An ornament according to claim 1, wherein said rings are secured to said jewelry holding member with positional offset from one another.

20. An ornament according to claim 1, wherein a gap is formed between the jewelry held by and fixed to said jewelry holding member and the finger inserted into said rings.

* * * * *